US006068086A

United States Patent [19]

Bushong et al.

[11] Patent Number: 6,068,086

[45] Date of Patent: May 30, 2000

[54] AUTOMATED MECHANISM TO FOLD AND UNFOLD LIFT TRUCK FORKS AND RELATED PROCESS

[75] Inventors: Jimmy Ray Bushong; Clint Emerson Bushong, both of Somis, Calif.

[73] Assignee: Southland Sod Farms, Port Hueneme, Calif.

[21] Appl. No.: 09/070,262

[22] Filed: Apr. 30, 1998

Related U.S. Application Data

[60] Provisional application No. 60/045,500, May 2, 1997.

[51] Int. Cl.[7] ..... B66F 9/12

[52] U.S. Cl. ..... 187/237; 414/785

[58] Field of Search ..... 187/222, 237, 187/238; 414/785

[56] References Cited

U.S. PATENT DOCUMENTS 3,232,380 2/1966 Hansen ..... 187/237

*Primary Examiner*—Kenneth W. Noland

*Attorney, Agent, or Firm*—Kelly Bauersfeld Lowry & Kelley, LLP

[57] ABSTRACT

In an automated process for folding and unfolding a lift truck fork in response to movement of a carriage relative to a supporting mast, the lift truck fork is pivotally supported on the carriage such that under normal conditions a fork tine extends outwardly generally perpendicularly from the carriage. A latch is provided which is connected to the mast and is capable of selectively engaging the lift truck fork. When the carriage is at or near the bottom of the mast, the latch may be selectively caused to engage the lift truck fork. With the latch so engaged, raising of the carriage causes the fork tine to pivot until it lies generally parallel to the carriage. Subsequent lowering of the carriage then causes the fork tine to pivot back to its unfolded position wherein it extends generally perpendicularly from the carriage. The latch is biased to normally remain out of engagement with the lift truck fork so that once the carriage is lowered, the latch disengages from the lift truck fork. The fork then remains unfolded as the carriage is subsequently raised and lowered relative to the mast.

17 Claims, 5 Drawing Sheets

AUTOMATED MECHANISM TO FOLD AND UNFOLD LIFT TRUCK FORKS AND RELATED PROCESS

This application claims priority from Provisional Application number 60/045,500, filed May 2, 1997.

BACKGROUND OF THE INVENTION

This invention relates generally to fork lift trucks. More specifically, the present invention relates to an automated mechanism to fold and unfold lift truck forks in response to movement of a carriage relative to a supporting mast in a fork lift mechanism.

Fork lift trucks are used by a wide variety of industries. They are one of the most common pieces of equipment used for material handling. Virtually all commodities are stacked on pallets at some point in their manufacturer or distribution and handled by fork lifts. Sometimes fork lifts are carried by delivery trucks to unload their cargos. Such is the case in the sod industry. When fork lifts are carried by trucks it is necessary to fold the forks in order to meet vehicle code and safety requirements.

A typical fork lift mechanism includes a generally vertical mast pivotally attached to the front of the fork lift truck and connected to one or more hydraulic rams which control the angle of inclination of the mast relative to a vertical plane. A carriage is slidably supported by the mast and a hydraulic mechanism is utilized to selectively raise and lower the carriage. The carriage will typically include an upper rail which supports a pair of L-shaped forks. In this regard, a fork mounting sleeve is provided at an extreme end of each L-shaped fork. The upper rail extends through the fork mounting sleeves so that the forks may pivot thereon as well as slide laterally. In normal use, a fork back extends downwardly from the fork mounting sleeve and then a fork tine extends horizontally outwardly from the carriage, generally perpendicularly from the fork back. The spacing between the forks may be adjusted by simply sliding the forks on the upper rail to the desired position.

In order to fold the forks in preparation for transporting the fork lift truck, a number of steps requiring considerable physical strength are necessary. By way of example, each of the forks typically must be slid to the respective extreme outside ends of the upper rail. When so positioned, each fork must be lifted and pivoted about the upper rail approximately 180° into a transport position. This process is quite difficult for an individual considering that a fork may weigh seventy-five pounds. As an alternative procedure, fork lift operators have also utilized a raised horizontal surface, such as the bed of a flat bed truck, to assist with the fork lift folding process.

During transport of the fork lift truck, the forks in the folded position extend upwardly from the upper rail and rest on brackets provided on each side of the mast. To unfold the forks, each must be manually pulled forward so as to pivot about the upper rail, and then be restrained from falling down onto the carriage. Again, this requires substantial physical effort, and some fork lift operators have developed techniques for utilizing a raised horizontal surface, such as that provided by a flat bed truck, to assist in the process and minimize the amount of manual labor required. Nevertheless, whether the forks are strictly manually folded and unfolded, or advanced folding and unfolding techniques are utilized, multiple steps and considerable physical strength are prerequisites for completing the task.

Accordingly, there is a need for a simple automated mechanical system capable of folding and unfolding forks for transport and operation. Preferably such an automated system would utilize the fork lift's existing hydraulics and be fully actuable from the driver's position on the fork lift truck. Additionally, such an automated mechanical system and related process is needed which may be adaptable to a wide variety of fork lift trucks, and which is easy to maintain and operate. The present invention fulfills these needs and provides other related advantages.

SUMMARY OF THE INVENTION

The present invention resides in an automated mechanism to fold and unfold lift truck forks, and a related process for folding and unfolding the forks in response to movement of a carriage relative to a supporting mast. Importantly, the fork lift mechanism utilizes standard hydraulic systems normally associated with fork lift trucks, and the process may be fully effected by the driver of the fork lift truck from the driving position.

In accordance with the invention, the lift truck fork is pivotally supported on the carriage such that under normal conditions a fork tine of the lift truck fork extends outwardly generally perpendicularly from the carriage in an unfolded position. A latch is connected to the mast and configured such that it is capable of selectively engaging the lift truck fork when the carriage is at or near the bottom of the mast. By raising the carriage, the fork tine is caused to pivot until it lies generally parallel to the carriage in a folded position. Thus, simply by raising the carriage relative to the mast, the lift truck fork may be pivoted from the unfolded position to the folded position. When it is desired to later unfold the lift truck fork, the carriage is simply lowered on the mast, which carriage movement causes the fork tine to pivot back to its unfolded position wherein it extends generally perpendicularly from the carriage. The latch is typically biased by means of a spring out of engagement with the lift truck fork. Thus, the latch must be intentionally and positively forced into engagement with the lift truck fork in order to fold the fork in response to movement of the carriage. Following the step of lowering the carriage, the latch may be disengaged from the lift truck fork so that the fork may then remain unfolded as the carriage is subsequently raised and lowered relative to the mast.

The fork lift mechanism itself comprises, generally, a mast, a carriage slidably supported by the mast, which carriage includes a backing plate, at least one fork pivotally supported by the carriage, including a fork tine and a fork back, and at least one latch supported by the mast. The at least one mast is capable of selectively engaging the fork back. Under normal operating conditions the at least one fork back engages the carriage backing plate so that the fork tine extends generally perpendicularly outwardly from the carriage as the carriage is moved relative to the mast. However, when the at least one latch is caused to engage the fork back, the fork back is pulled away from the backing plate as the carriage is raised to cause the fork tine to pivot and lie generally parallel to the carriage.

In the illustrated embodiment, a plurality of forks are pivotally supported by the carriage. Each fork includes a fork tine, a fork back which extends generally perpendicularly to the fork tine, and a mounting sleeve between the fork tine and the fork back. A fork mounting shaft supported by the carriage extends through the mounting sleeve to permit pivotal movement of the fork about the mounting shaft.

A plurality of latches, corresponding to the plurality of forks, are supported by the mast, each latch being pivotable between a fork back engaging position and a neutral position. Means are provided for biasing the latches toward their neutral position, and further means are provided for selectively moving the latches between the engaging and neutral positions. The biasing means includes a spring which extends between at least one of the latches and the mast. The latch moving means comprises a cable linkage which extends from each of the latches rearwardly for actuation by a driver of the fork lift truck.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
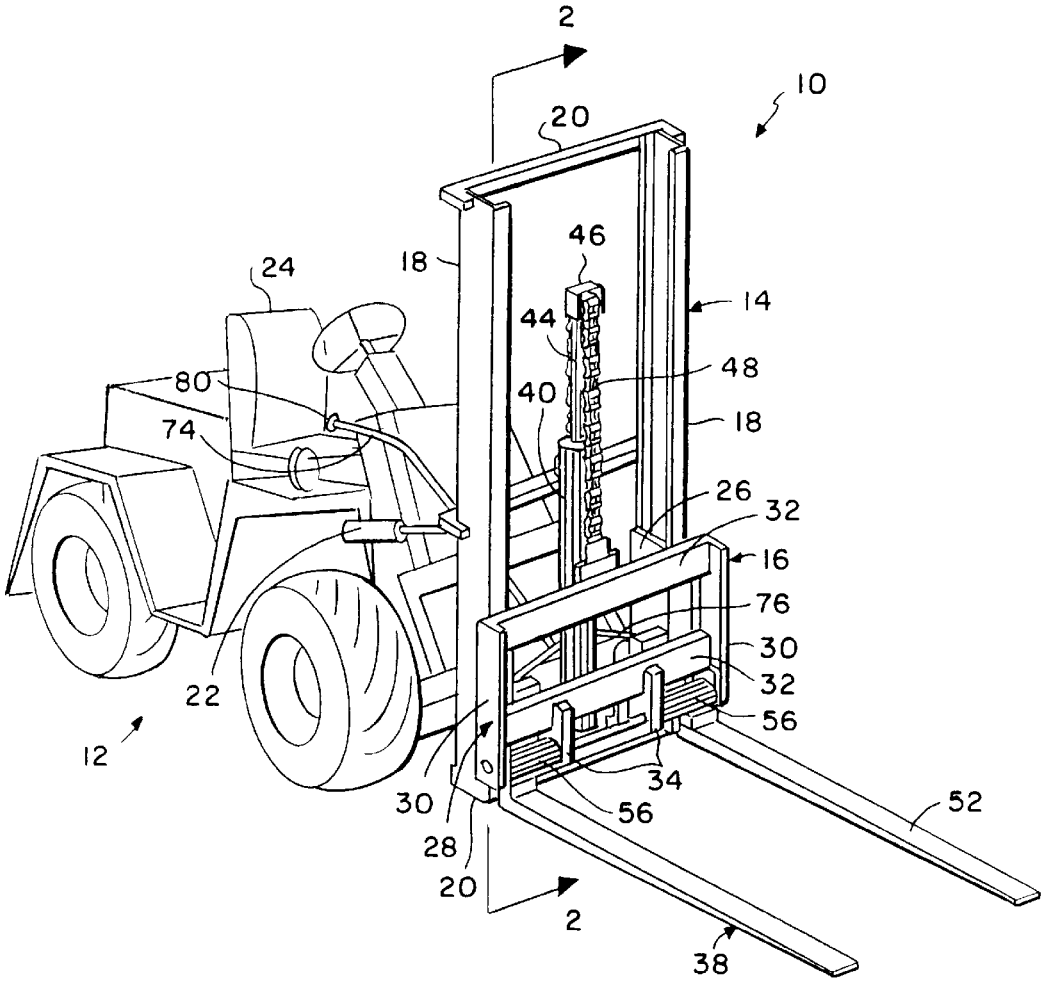
FIG. 1 is a front and side perspective view of a fork lift truck having a fork lift mechanism embodying the invention, wherein the forks are shown in an unfolded position.

As shown in the drawings for purposes of illustration, the present invention is concerned with an improved fork lift mechanism, generally designated in the accompanying drawings by the reference number 10. The fork lift mechanism 10 is typically associated with a fork lift truck 12, and includes a mast 14 that is pivotally supported at a front end of the truck 12, and a carriage 16 which is slidably supported by the mast 14.

The mast 14 is of a generally standard construction and includes a pair of side rails 18 connected at their upper and lower ends by connecting beams 20. A pair of hydraulic rams 22 extend forwardly from a front end of the fork lift truck 12 to the mast 14 to permit an operator seated on a seat 24 on the truck 12 to be able to control the vertical angular orientation of the mast 14 about its lower pivot connection to the truck 12.

The carriage 16 includes a pair of track members 26 that are configured to slide vertically within the side rails 18 of the mast 14. A carriage superstructure 28 is connected to the track members 26 and extends forwardly therefrom to lie generally adjacent to a forward side of the mast 14. The superstructure 28 includes a pair of side support members 30 which extend vertically generally adjacent to the track members 26, and a pair of backing plates 32 which extend laterally between the side support members 30. Connected to and extending downwardly from the lower one of the backing plates 32 are a pair of lower support brackets 34 which are equidistantly spaced from the respective side support members 30. A fork mounting shaft 36 is supported between each lower support bracket 34 and its adjacent side support member 30, and it is these shafts 36 which provide the primary pivotal support for the lift truck forks 38. Of course it will be understood by those of skill in the art that modifications to the above-described structure may be made. For example, the lower support brackets 34 could be eliminated and a single fork mounting shaft 36 provided which extends the entire width of the carriage superstructure 28 between the opposing side support members 30.

A lifting hydraulic ram 40 is fixed to the mast 14. Specifically, a lower end of the ram 40 is secured to a lower one of the connecting beams 20. The hydraulic ram 40 is of standard construction and includes a lower cylinder 42 and an upper piston 44. The upper end of the piston 44 is fitted with a carriage lifting chain guide 46 through or over which a carriage lifting chain 48 extends. A lifting chain anchor 50, in the form of a bar, extends laterally across the mast 14 and is fixed to the side rails 18. One end of the lifting chain 48 is secured to the anchor 50. The other end of the lifting chain is secured to the carriage superstructure 28, and specifically to an upper one of the backing plates 32. As the piston 44 is raised relative to the cylinder 42, the lifting chain 48 will pull the carriage 16 upwardly relative to the mast. Conversely, as the piston 44 is lowered relative to the cylinder 42, the lifting chain 46 will permit the carriage 16 to be lowered relative to the mast 14, all in a standard fashion.

Figure 8:
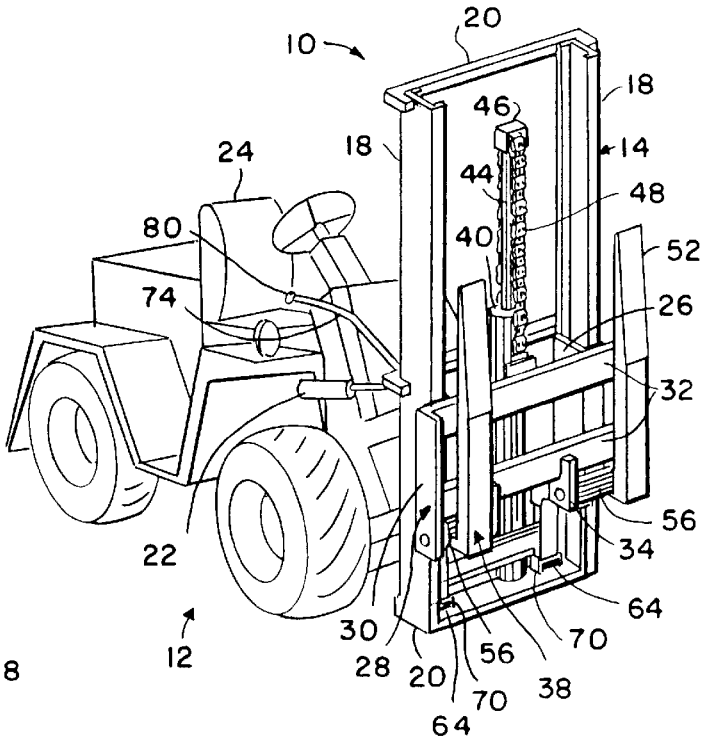
FIG. 8 is a front and side perspective view of the fork lift truck of FIG. 1, wherein the forks have been fully pivoted into a folded position.

The lift truck forks 38 carried by the carriage 16 include a fork tine 52 configured to extend forwardly and generally perpendicularly outwardly from the carriage under normal operating conditions, a fork back 54 which extends generally perpendicularly to the fork tine, and a mounting sleeve 56 between the fork tine and the fork back. The mounting sleeve 56 is positioned and configured to receive therein a respective one of the fork mounting shafts 36 supported by the carriage 16 to permit pivotal movement of the lift truck forks 38 between an unfolded position (wherein the fork tine 52 extends outwardly generally perpendicularly to the carriage—FIG. 1) and a folded position (wherein the fork tine is pivoted about the fork mounting shaft 36 to lie generally parallel to the carriage—FIG. 8). Extending rearwardly from each fork back 54, near an upper end thereof, are a pair of latch brackets 58 that support a latch pin 60 therebetween. The latch pins 60 of the lift truck forks 38 may be selectively engaged by a latch 62 supported by the mast 14 to automate the folding and unfolding of the lift truck forks 38 relative to the carriage 16.

The latches 62, which correspond to the lift truck forks 38, each include a lower sleeve 64 and an upper hook 66. The lower sleeve 64 pivots about a latch pivot pin 68 that is secured to the lower mast connecting beam 20 by means of a pair of latch pivot pin supporting brackets 70. Each latch 62 is configured so that the upper hook 66 is capable of capturing a respective latch pin 60 associated with each fork back 54 when an operator of the fork lift truck 12 desires to hold the lift truck forks 38. Under normal operating conditions, however, it is desired to keep the latches 62 pivoted away from the latch pins 60 to allow the lift truck forks 38 to remain in their unfolded position as the carriage 16 is raised and lowered relative to the mast 14. To help accomplish this, a spring 72 is provided to help bias the latches 62 out of engagement with the lift truck forks 38. Further, a cable linkage 74 that is actuable by an operator of the fork lift truck 12 from the seat 24 thereof is provided to permit the operator to positively selectively control the positioning of the upper hook portion 66 of the latches 62 between a fork back engaging position (FIGS. 4–7) and a neutral position (FIG. 2).

More particularly, a connecting arm 76 extends from each latch 62 in a manner to interconnect the latches 62 to ensure that the latches are each in the same pivotal orientation about the latch pivot pins 68. A linkage arm 78 extends rearwardly from the connecting arm 76 to a control knob 80 which the operator of the fork lift truck 12 may grasp to positively and selectively position the latches 62 as desired.

Figure 3:
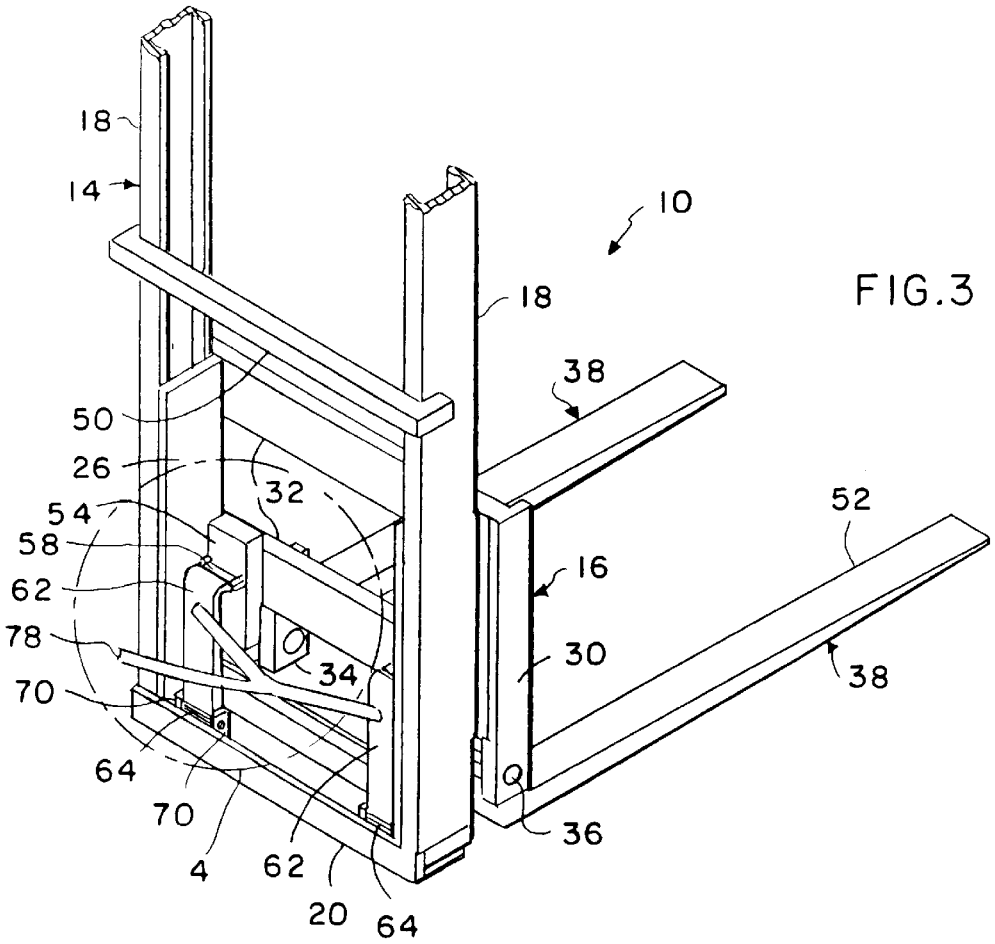
FIG. 3 is a rear elevational view of the fork lift mechanism taken generally along the line 3—3 of FIG. 2.
Figure 4:
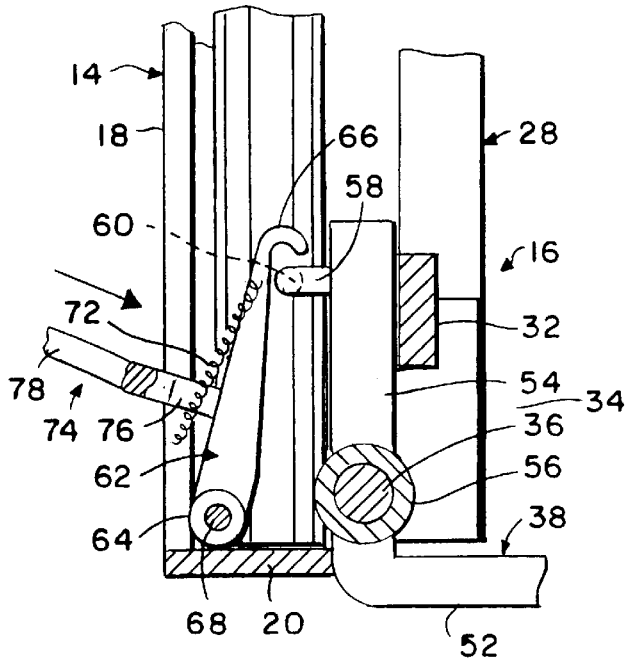
FIG. 4 is an enlarged fragmented vertical section taken generally of the area indicated by the number 4 in FIG. 2, further illustrating the manner in which a latch may be positioned relative to a latch bracket to engage a portion of a lifting fork.
Figure 5:
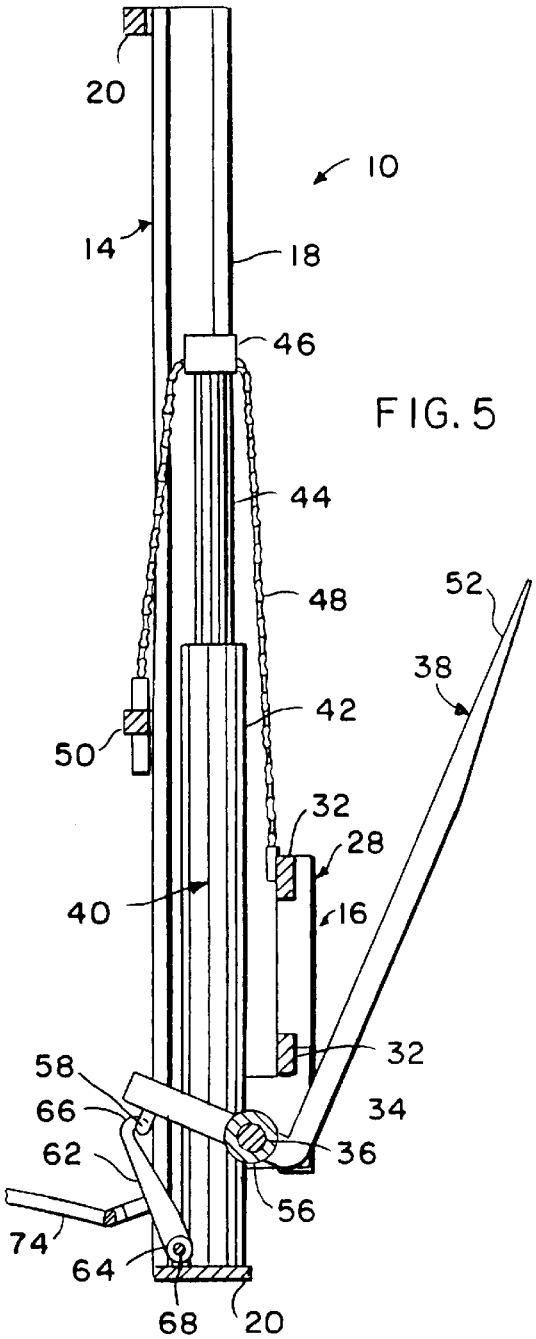
FIG. 5 is a vertical section similar to that illustrated in FIG. 2, illustrating the manner in which a lifting fork is pivoted about a fork mounting shaft as a carriage is raised relative to a mast when the latch is positioned to engage the latch bracket of the lifting fork.
Figure 6:
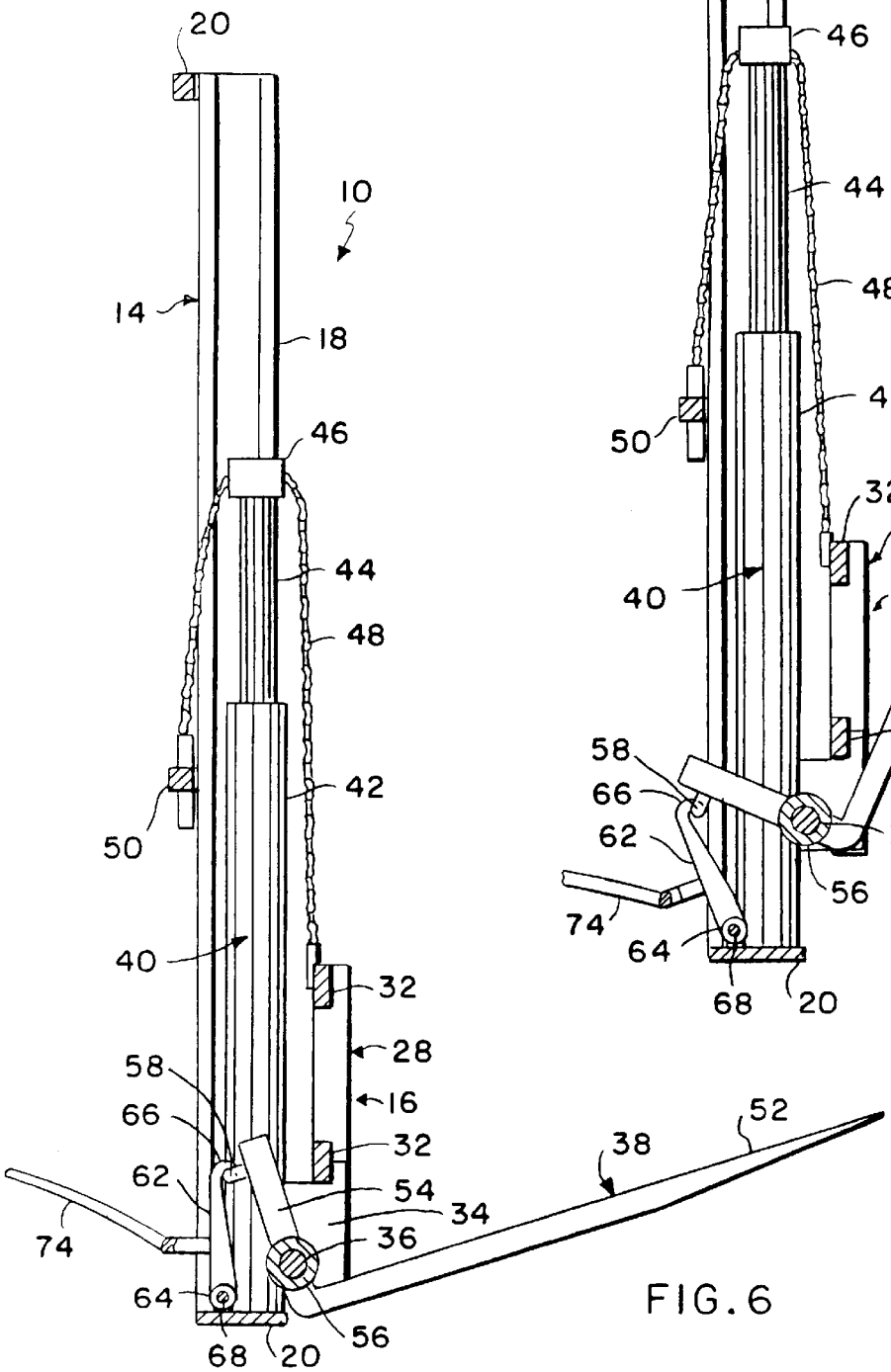
FIG. 6 is a vertical section similar to FIGS. 2 and 5, illustrating the angular position of the lifting fork as the carriage is further raised relative to the mast.

In operation, the lift truck forks 38 are normally in their unfolded position as illustrated in FIG. 1. In this position the fork tines 52 extend perpendicularly outwardly from the carriage 16 and the mast 14. Further downward rotation of the fork tines 52 is prevented by engagement between the fork backs 54 and the lower carriage backing plate 32 (FIGS. 2–4). With the latches 62 pulled rearwardly by the cable linkage 74 and as biased by the spring 72 into the neutral position (FIG. 2), the operator may raise and lower the carriage 16 relative to the mast in a normal fashion.

Figure 2:
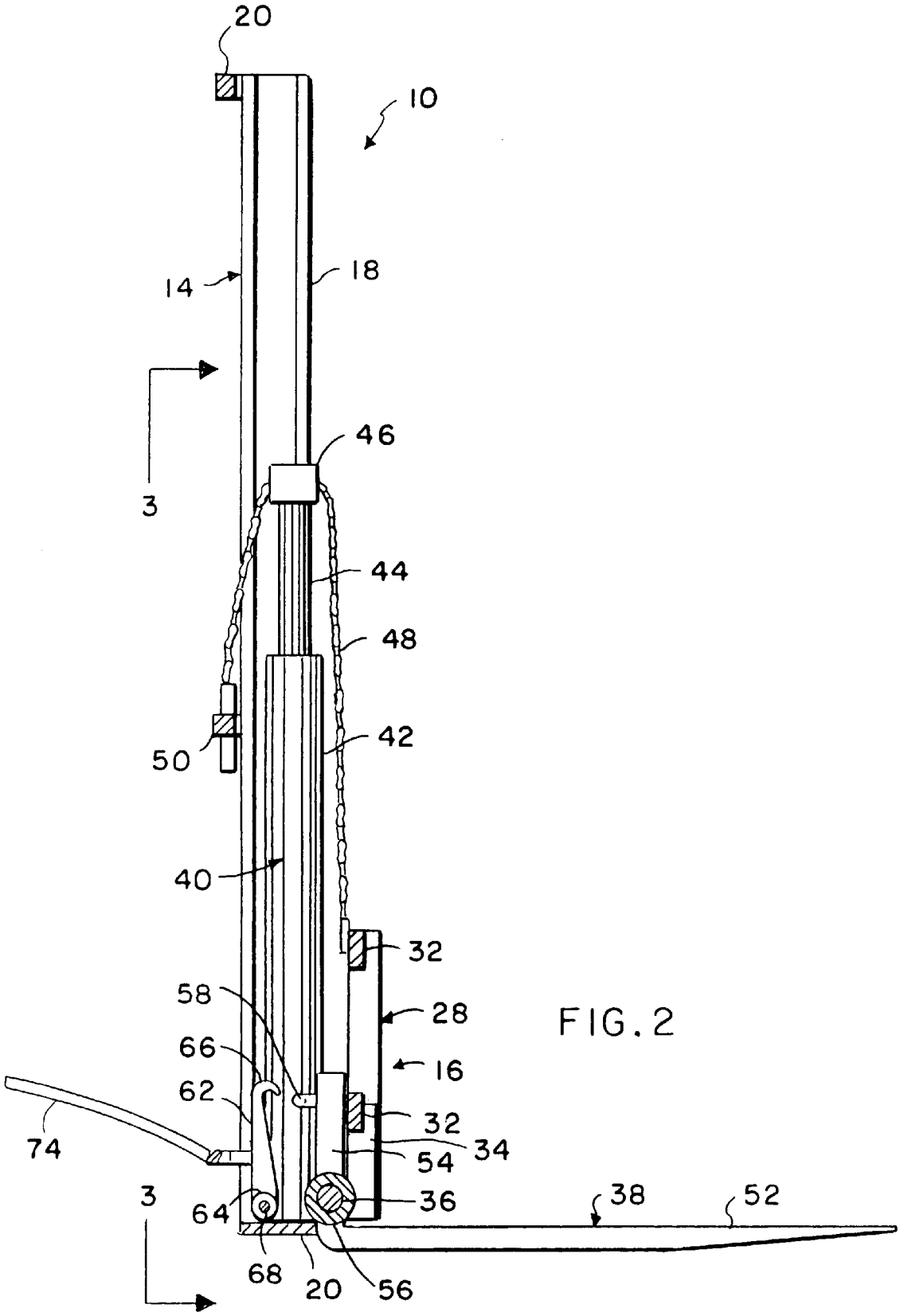
FIG. 2 is an enlarged vertical section taken generally along the line 2—2 of FIG. 1, illustrating the various components of the novel fork lift mechanism.
Figure 7:
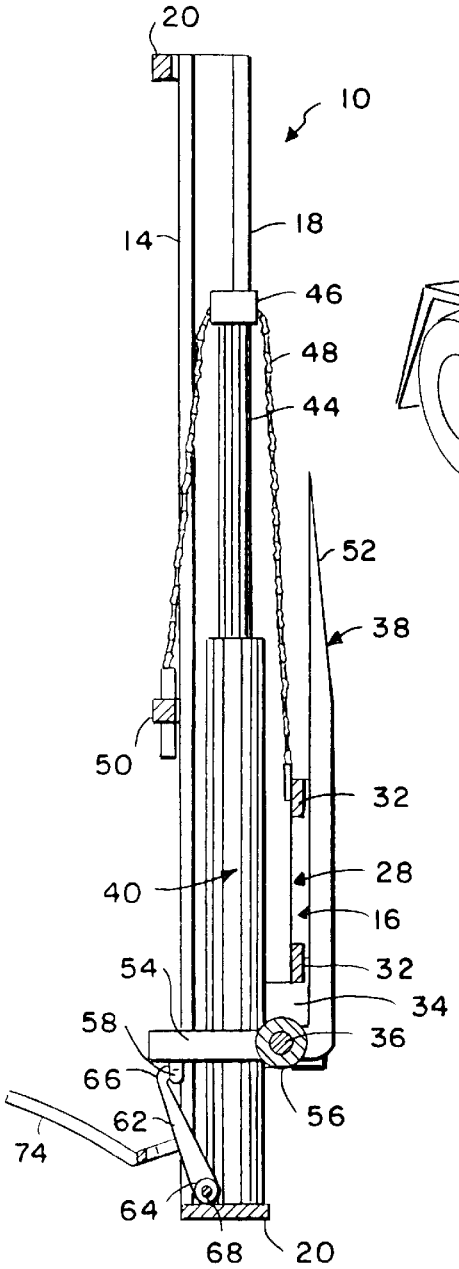
FIG. 7 is another vertical section similar to FIGS. 2, 5 and 6, illustrating completion of the fork folding process as the carriage is further raised relative to the mast.

To pivot the lift truck forks 38 to the folded position (FIG. 8), the carriage is first fully lowered (FIG. 2). The operator then pushes forwarding on the cable linkage control knob 80 which, in turn, causes the linkage arm 78 and the connecting arm 76 to move forwardly to pivot the latches 62 so that the upper hook 66 of each latch 62 is positioned directly over a respective latch pin 60 mounted on the fork backs 54. The carriage 16 may then be raised using the conventional fork lift hydraulics (the lifting ram 40). As the carriage 16 is first lifted upwardly, the upper hooks 66 will engage the latch pins 60. Further upward movement of the carriage causes the lift truck forks 38 to pivot about the fork mounting shafts 36 (FIGS. 5 and 6) until the fork tines 52 are rotated from the horizontal position (FIG. 2) to the vertical position (FIG. 7). Once the lift truck forks 38 have been fully folded (FIGS. 7 and 8), the carriage 16 cannot be raised in any further and the raising hydraulics circulate through a hydraulic valve pressure bypass. When the hydraulic valve is placed in neutral the forks remain in the vertical transport or folded position.

It has been found that once the forks 38 are placed in the folded position and the fork lift truck is shut down, the forks may, slowly over the course of several hours, unfold back into the horizontal operating position. This is typically caused by normal hydraulic leakage inside the mast/carriage ram control valve. To overcome this problem, a hydraulic pressure accumulator and a pilot operated check valve in the hydraulic circuit that controls the mast/carriage ram is provided. The check valve stops the leakage and the accumulator maintains pressure in the hydraulic system when the fork lift truck is shut down.

To unfold the lift truck forks 38 for operation, the hydraulic valve is actuated to lower the piston 44 and thus the carriage 16. The forks, and specifically the fork tines 52, automatically unfold until they reach the horizontal or unfolded position (FIGS. 1 and 2). As the carriage 16 lowers further, the upper hooks 66 of the latches 62 disengage from the latch pins 60. The operator may then grasp the control knob 80 to pull the cable linkage 74 rearwardly to clear the latch pins 60 of the latches 62. At this point the fork lift mechanism 10 is ready for operation in a standard fashion and the carriage 16 can be raised and lowered as needed relative to the mast, without engaging the folding mechanism until desired.

From the foregoing it will be appreciated that the present invention requires only the operation of the fork lifts' existing hydraulics and an additional cable linkage to permit much faster and easier fork folding and unfolding in comparison with the manual methods now required. The process for folding and unfolding the lift truck forks 38 in response to movement of the carriage 16 relative to the mast 14 has been greatly simplified. In this regard the process comprises the steps of pivotally supporting the lift truck fork on the carriage such that under normal conditions the fork tines 52 extend outwardly generally perpendicularly from the carriage 16 in an unfolded position, causing the latches 62 to engage the lift truck forks 38 when the carriage is at or near the bottom of the mast, raising the carriage to cause the fork tines 52 to pivot until they are caused to lie generally parallel to the carriage in a folded position, and subsequently lowering the carriage to cause the fork tines to pivot back to their unfolded position wherein they extend generally perpendicularly from the carriage.

Although a particular embodiment of the invention has been described in detail for purposes of illustration, various modifications may be made without departing from the spirit and scope of the invention. For example, one of skill in the art would readily appreciate that modifications may be made to the spring and the cable linkage 74 to permit the operator to quickly and easily engage or disengage the latch pins 60 associated with the fork backs 54. Moreover, other types of latches 62 may be advantageously utilized in connection with the invention, including electrically actuated solenoids and the like. Accordingly, the invention is not to be limited, except as by the appended claims.

We claim:

1. A fork lift mechanism, comprising:

a mast;

a carriage slidably supported by the mast, the carriage including a backing plate;

at least one fork pivotally supported by the carriage, including a fork tine and a fork back; and at least one latch supported by the mast, the at least one latch capable of selectively engaging the fork back;

wherein under normal operating conditions the at least one fork back engages the carriage backing plate so that the fork tine extends generally perpendicularly outwardly from the carriage as the carriage is moved relative to the mast, but when the at least one latch is caused to engage the fork back, the fork back is pulled away from the backing plate as the carriage is raised to cause the fork tine to pivot and lie generally parallel to the carriage.

2. The fork lift mechanism of claim 1, wherein the at least one fork includes a mounting sleeve between the fork tine and the fork back, and wherein a fork mounting shaft supported by the carriage extends through the mounting sleeve to permit pivotal movement of the at least one fork about the mounting shaft.

3. The fork lift mechanism of claim 1, wherein the at least one latch is pivotable between a fork back engaging position and a neutral position.

4. The fork lift mechanism of claim 3, including means for biasing the at least one latch towards its neutral position.

5. The fork lift mechanism of claim 4, wherein the biasing means includes a spring extending between the at least one latch and the mast.

6. The fork lift mechanism of claim 3, including means for selectively moving the at least one latch between the engaging and the neutral positions.

7. The fork lift mechanism of claim 6, wherein the latch moving means comprises a cable linkage extending from the at least one latch.

8. The fork lift mechanism of claim 1, wherein the at least one fork comprises a plurality of forks pivotally supported by the carriage, and wherein the at least one latch comprises a plurality of latches corresponding to the plurality of forks.

9. The fork lift mechanism of claim 8, wherein the plurality of latches are pivotable between a fork back engaging position and a neutral position, and wherein the fork lift mechanism includes means for selectively moving the plurality of latches between the engaging and the neutral positions.

10. The fork lift mechanism of claim 9, wherein the latch moving means comprises a cable linkage extending from the plurality of latches.

11. The fork lift mechanism of claim 9, including means for biasing the plurality of latches toward their neutral positions, wherein the biasing means includes a spring extending between at least one of the latches and the mast.

12. A fork lift mechanism, comprising:

a mast;

a carriage slidably supported by the mast, the carriage including a backing plate;

a plurality of forks pivotally supported by the carriage, each including a fork tine, a fork back extending generally perpendicularly to the fork tine, and a mounting sleeve between the fork tine and the fork back, wherein a fork mounting shaft supported by the carriage extends through each mounting sleeve to permit pivotal movement of the fork about the mounting shaft;

a plurality of latches corresponding to the plurality of forks and supported by the mast, each latch being pivotable between a fork back engaging position and a neutral position;

means for biasing the latches toward their neutral position; and means for selectively moving the latches between the engaging and the neutral positions;

wherein under normal operating conditions the fork backs engage the carriage backing plate so that the fork tines extend generally perpendicularly outwardly from the carriage as the carriage is moved relative to the mast, but when the latches are caused to engage the fork backs, the fork backs are pulled away from the backing plate as the carriage is raised to cause the fork tines to pivot and lie generally parallel to the carriage.

13. The fork lift mechanism of claim 12, wherein the biasing means includes a spring extending between at least one of the latches and the mast.

14. The fork lift mechanism of claim 12, wherein the latch moving means comprises a cable linkage extending from each of the latches.

15. A process for folding and unfolding a lift truck fork in response to movement of a carriage relative to a supporting mast, comprising the steps of:

pivotally supporting the lift truck fork on the carriage such that under normal conditions a fork tine of the lift truck fork extends outwardly generally perpendicularly from the carriage in an unfolded position;

providing a latch connected to the mast and capable of selectively engaging the lift truck fork;

causing the latch to engage the lift truck fork when the carriage is at or near the bottom of the mast;

raising the carriage to cause the fork tine to pivot until it is caused to lie generally parallel to the carriage in a folded position; and subsequently lowering the carriage to cause the fork tine to pivot back to its unfolded position wherein it extends generally perpendicularly from the carriage.

16. The process of claim 15, including the step of biasing the latch out of engagement with the lift truck fork.

17. The process of claim 16, wherein following the step of lowering the carriage, the latch disengages from the lift truck fork to permit it to remain unfolded as the carriage is subsequently raised relative to the mast.

* * * * *